US006764151B2

(12) United States Patent
Huang

(10) Patent No.: US 6,764,151 B2
(45) Date of Patent: Jul. 20, 2004

(54) GUIDE RAIL FOR A DRAWER

(75) Inventor: Kuo-Sheng Huang, Taipei Hsien (TW)

(73) Assignee: Nan Juen International Co., Ltd., Taipei (TW)

( * ) Notice: Subject to any disclaimer, the term of this patent is extended or adjusted under 35 U.S.C. 154(b) by 0 days.

(21) Appl. No.: 10/359,685

(22) Filed: Feb. 7, 2003

(65) Prior Publication Data

US 2004/0119388 A1 Jun. 24, 2004

(30) Foreign Application Priority Data

Dec. 20, 2002 (TW) ..... 91220736 U

(51) Int. Cl.[7] ..... A47B 88/04
(52) U.S. Cl. ..... 312/334.46; 312/334.44
(58) Field of Search ..... 312/330.1, 334.1, 312/334.7, 334.16, 334.17, 334.44, 334.46, 333; 384/20, 21

(56) References Cited

U.S. PATENT DOCUMENTS 2,277,702 A * 3/1942 Kennedy ..... 312/334.8
3,039,838 A * 6/1962 Koch, Jr. et al. ..... 384/21
3,589,778 A * 6/1971 Olson ..... 384/21
3,650,578 A * 3/1972 Del Vecchio et al. ..... 384/18
3,658,394 A * 4/1972 Gutner ..... 384/21
5,248,195 A * 9/1993 Shin ..... 312/334.33

* cited by examiner

*Primary Examiner*—James O. Hansen
(74) *Attorney, Agent, or Firm*—Troxell Law Office PLLC

(57) ABSTRACT

A guide rail for a drawer includes a stationary rail, a movable rail and a ball device. The movable rail is received in the stationary rail and the ball device disposed between the stationary rail and the movable rail. The stationary rail at an outer end thereof integrally extends upward a hollow stopper on the flat intermediate side thereof and the movable rail at the inner end thereof integrally extends downward a projection so that the stopper can press against the projection to constitute the outward movement limit of the movable rail. When the movable rail is forced to pull outward, the projection is exerted with a foreign force along an inner side of the stopper to become deformed and passes over the stopper so that the movable rail can slide apart from the stationary rail. When the movable rail is forced to pull outward, the projection is exerted with a foreign force along an inner side of the stopper to become deformed and passes over the stopper so that the movable rail can slide apart from the stationary rail.

2 Claims, 4 Drawing Sheets

GUIDE RAIL FOR A DRAWER

BACKGROUND OF THE INVENTION

1. Field of the Invention

The present invention relates to an improvement of a guide rail for a drawer and particularly to a movable rail being enforced to pull out from a stationary rail and a ball device being caught at the outer end of the stationary rail so as to facilitate the movable rail joined to the stationary rail during being inserted into the stationary rail.

2. Description of Related Art

The drawer is formed of an open top box with a lateral side thereof being attached with a movable rail of a slide rail and a stationary rail of the slide rail being joined to an inner wall of a space in a furniture reserved for a drawer. Thus, the drawer is possible to be pushed into or pulled out from the space by way of the function of the slide rail during being moved.

In fact, in order to avoid the movable rail being separate from the stationary rail completely, the stationary rail at the outer end thereof is provided with a stopper and the stopper mostly is an integrally stamped projection fitting with an elastic piece made of plastic or rubber under a consideration of the drawer being fixed up and repaired. Thus, the preset projection pass over the elastic to allow the movable rail moving apart from the stationary rail. However, the preceding elastic piece is incapable of being assembled to the stationary rail automatically with machinery such that it results in a tedious assembling job and high labor cost with extraordinary expenditure of mold tool. Consequently, the production cost of the slide rail for the drawer always keeps high and is unable to be lowered down.

Moreover, the movable rail moves relative to a ball device of the stationary rail so that the ball device can move as soon as the movable rail displaces. Under this circumstance, if the ball device is not possible to be located at the outer end of the stationary rail during the movable rail moving away the stationary rail, the ball device displaces and is unable to join with the movable rail while the movable rail is inserted to the drawer for assembling with the stationary rail. Hence, it is necessary to locate the ball device and the conventional way is a plastic projection is used for locating the ball device. However, the deficiency of providing the projection is the same as the preceding elastic piece and it does not meet the economic effectiveness.

SUMMARY OF THE INVENTION

A primary object of the present invention is to provide a slide rail for a drawer, which includes a stationary rail, a ball device and a movable rail, and the stationary and the movable rail are formed by way of integral stamp so as to obtain a stopper with a slight elasticity and a projection so that inconvenience and high cost resulting from mounting the elastic piece can be avoided.

Another object of the present invention is to provide a slide rail for a drawer, wherein the outer end of the stationary rail thereof integrally forms catch hooks to locate the ball device so as to facilitate the movable rail joining with the ball device.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
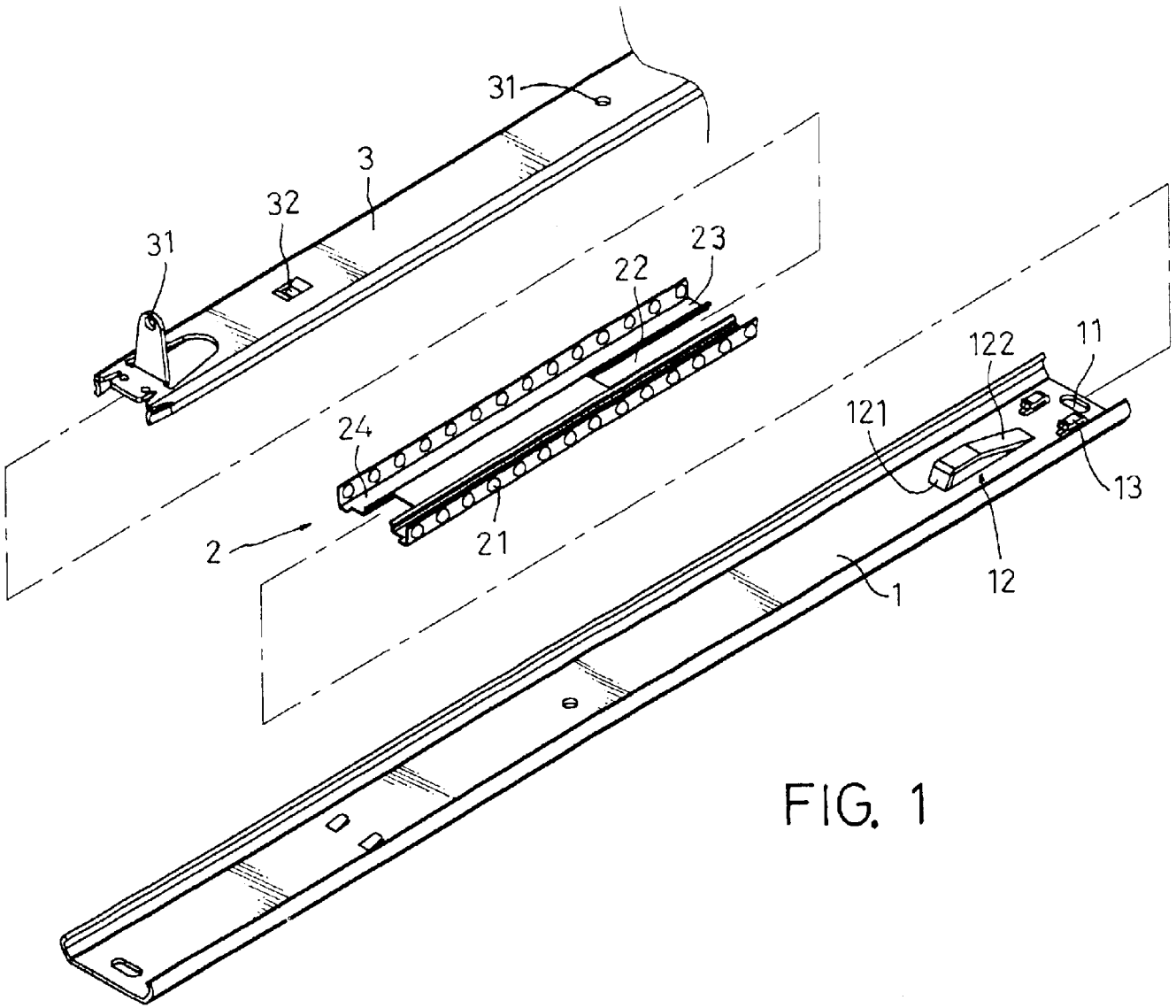
FIG. 1 is a perspective view of a guide rail for a drawer according to the present invention.
Figure 2:
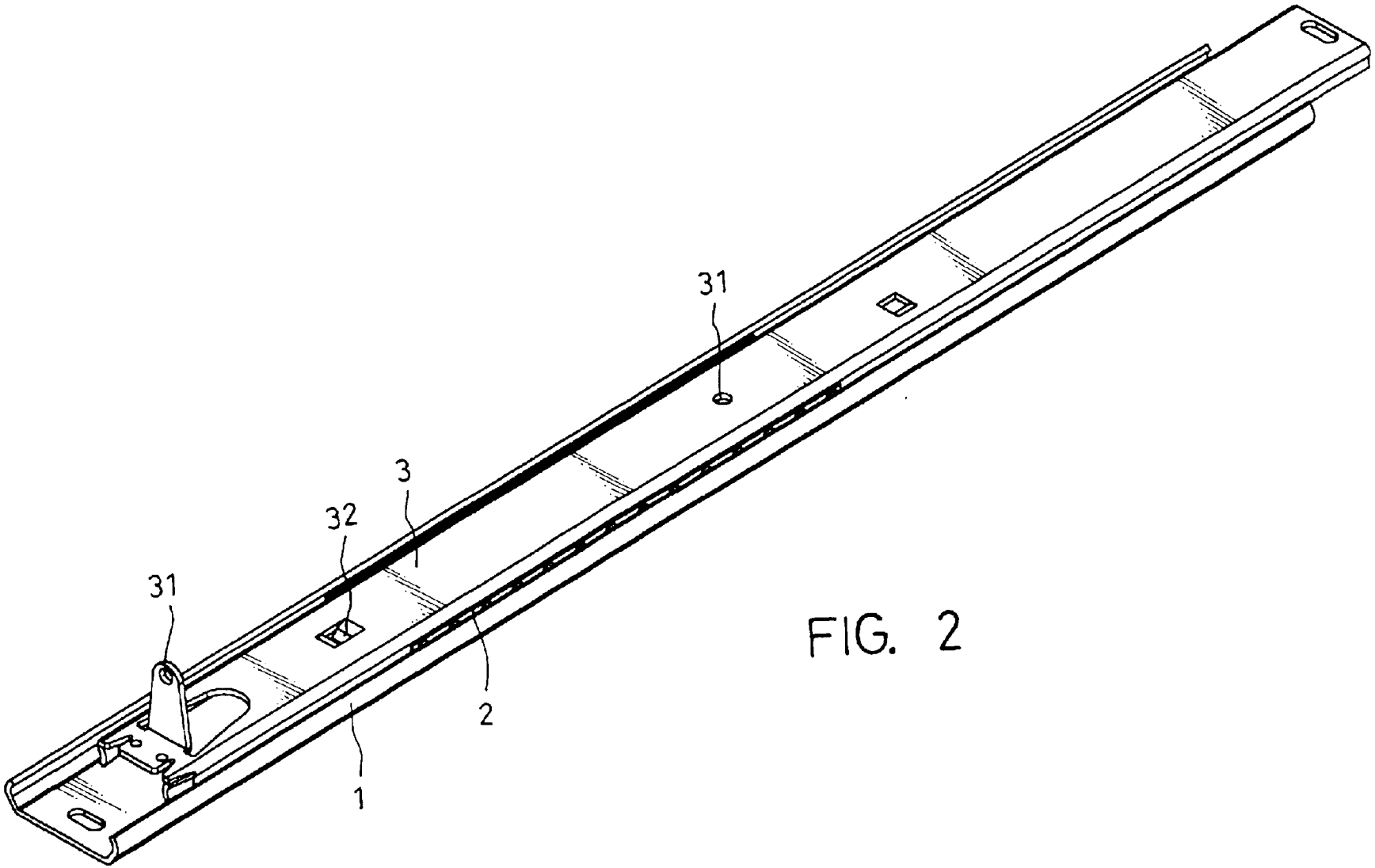
FIG. 2 is an assembled perspective view of the guide rail shown in FIG. 1.

Referring to FIGS. 1, 2, 3*a* and 3*b*, basically, a guide rail for a drawer according to the present invention includes a stationary rail 1, a ball device 2, and a movable rail 3.

Wherein, the stationary rail 1 is a channel shaped bar with a lower flat side thereof having a joining device 11 such as frame holes/grooves being fixedly attached to the inner wall of the drawer with screws passing through the frame holes/groove. These are conventional arts so that no detail will be described further. The innovation of the present invention is in that the stationary rail 1 at the outer end thereof is integrally stamped a hollow trapezoidal stopper 12 with the stopper 12 at the inner side thereof having a slight up slant stopper end 121 pressing against a projection 32 of the movable rail 3 and at the outer side thereof extending downward a declining plane 122 as a basis of displacement during the projection 32 being inserted into the stationary rail 1. Besides, in order to locate the ball device 2, an end part of the stationary rail 1 next to at least one of two lateral sides thereof provides an integrally stamped catch hook 13 near the outer side of the stopper 12 with an opening thereof facing inward. The stationary rail 1 at the inner side thereof integrally protrudes at least a stop rib corresponding to the catch hook 13 as a limit for an inner movement of the ball device 2.

The ball device 2 is a channel bar corresponding to a section of the stationary rail 1 with two lateral sides thereof being provided with a plurality of rolling balls 21 so that the rolling balls 21 can slide along two lateral sides of the stationary rail 1 once the ball device 2 fits with the stationary rail 1. The difference of the ball device 2 from the prior art is in that an end of the ball device 2 has an extending inward lower open groove 22 corresponding to the stopper 12 at the outer end of the stationary rail 1 with two lateral sides thereof having a hook end respectively for engaging with the catch hook 13 for the movable rail 3 being held during being pulled outward. Besides, the ball device 2 at another end thereof forms a rib end 24 corresponding to the stop rib such that it is the inner movement limit of the ball device 2 while the rib end 24 contacts with the stop rib.

The movable rail 3 is a channel bar corresponding to the ball device 2 and disposed opposite to the stationary rail 1 with an upper flat side thereof having joining device 31 such as locating holes/grooves for being passed through screws and fastened to a lateral wall of the drawer. Because the part of the movable rail 3 being fastened to the drawer belongs to the prior art so that no detail will be described further. The movable rail 3 at the inner end thereof has the integrally stamped projection 32 corresponding to the stopper 12 such that it is the outer movement limit of the movable rail 3 while the projection 32 contacts with the stopper 12.

Figure 3A:
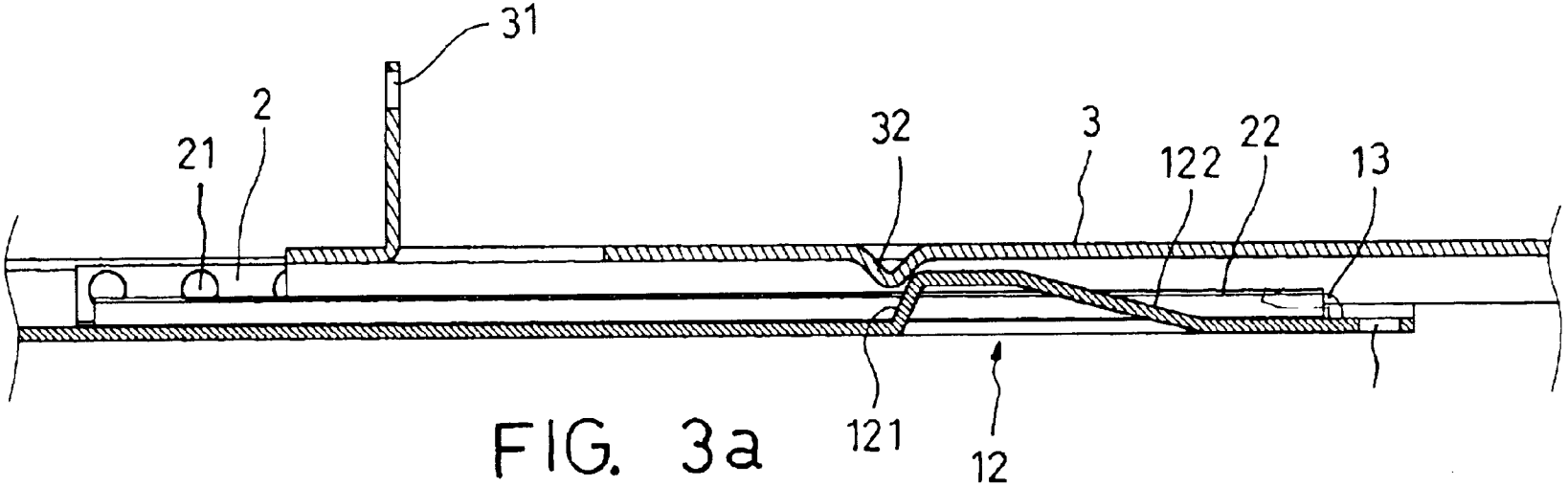
FIGS. 3*a* and 3*b* are fragmentary sectional views of the guide rail according to the present invention illustrating a stopper and an engaging jut thereof.
Figure 3B:
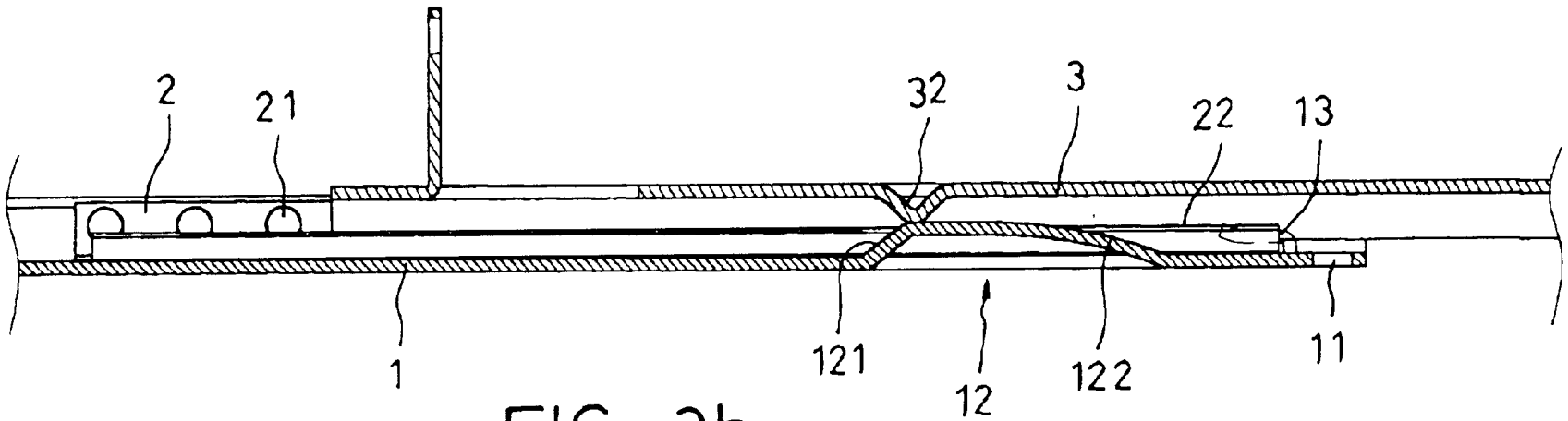

Referring to FIGS. 3*a* and 3*b*, when the movable rail 3 is pulled outward, the movable rail 3 moves along the stopper end 121 and the foreign force exerts to the stopper 12 so that the stopper 12 is deformed and the entire movable rail 3 can be pulled to be away the stationary rail 1 as soon as the projection 32 passes over the stopper end 121.

Figure 4:
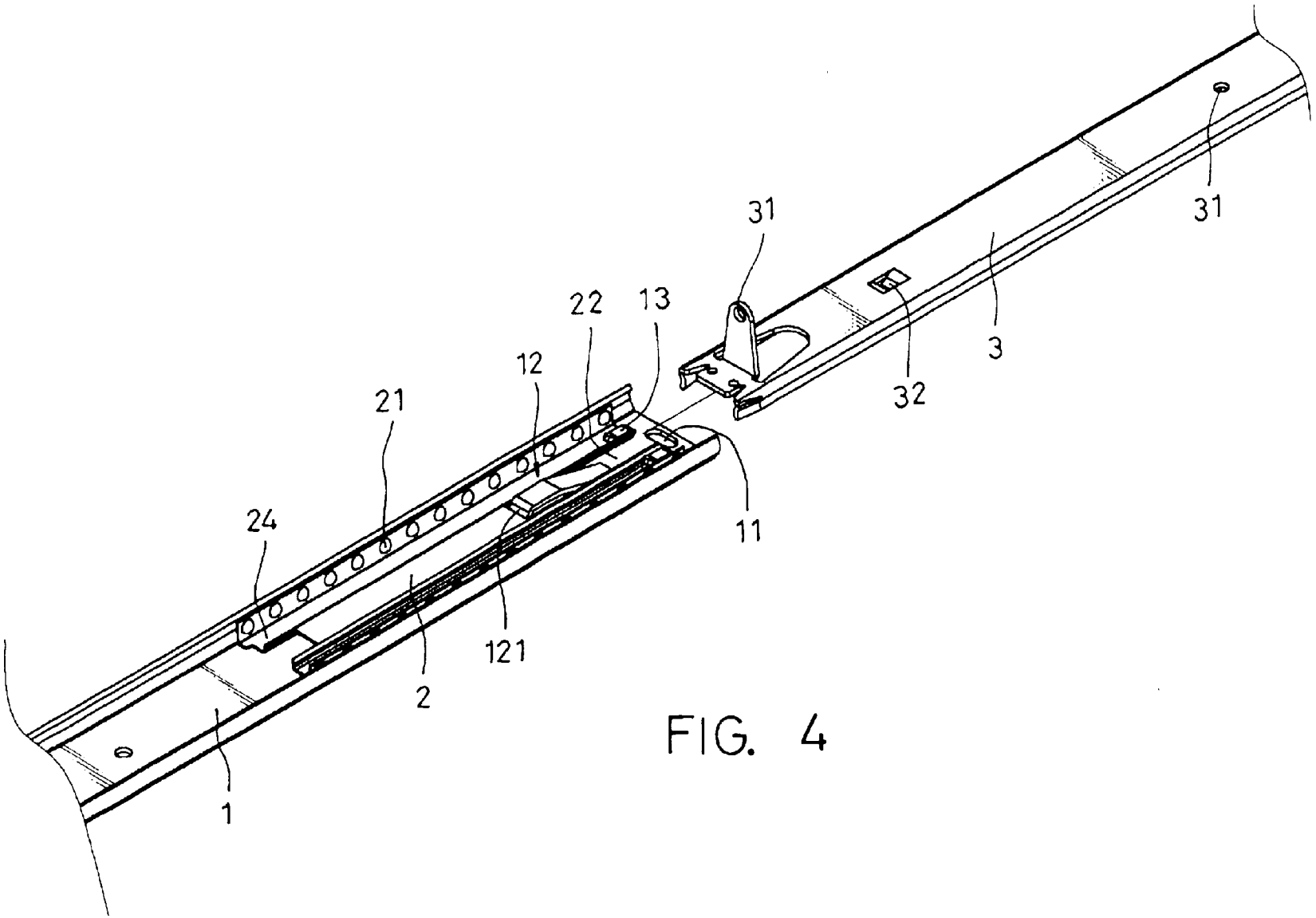
FIG. 4 is a fragmentary perspective view of the guide rail according to the present invention illustrating a movable rail being detached from a stationary rail.

Referring to FIG. 4, the ball device 2 moves with the movable rail 3 and the stopper 12 can be received in the lower open groove 22 at the time of the movable rail 3 being pulled apart from the stationary rail 1 so that the movable rail 3 can be in a state of being located during the hook end 23 on the ball device 2 engaging with the catch hook 13. When the movable rail 3 is inserted Into the stationary rail 1, the end part of the movable rail 3 can be joined to the balls 21 at two lateral sides of the ball device 2 so as to detach the hook end 23 from the catch hook 13 successfully.

It is appreciated that the guide rail for a drawer according to the present invention provides an integrally stamped stationary rail and an integrally stamped movable rail. Then, a slightly elastic stopper and a projection are formed to avoid the inconvenience and the high cost resulting from assembling an elastic, piece. Furthermore, the stationary rail at the open end thereof is integrally made with catch hooks for engaging with the ball device to facilitate the joint of the stationary rail to the movable rail instead of providing a catch part so that it is capable of free from many shortcomings caused by the catch part.

While the invention has been described with reference to a preferred embodiment thereof, it is to be understood that modifications or variations may be easily made without departing from the spirit of this invention, which is defined by the appended claims.

What is claimed is:

1. A guide rail for a drawer assembly comprising:

a stationary rail;

a movable rail received in the stationary rail; and a ball device located between the stationary rail and the movable rail;

wherein the stationary rail at an outer end thereof integrally extends upward a hollow stopper on a flat intermediate side thereof and the movable rail at an inner end thereof integrally extends downward a projection so that the hollow stopper presses against the projection to constitute an outward movement limit of the movable rail;

wherein, when the movable rail is pulled outwardly, the projection is exerted with a force along an inner side of the stopper to become deformed and passes over the stopper so that the movable rail can slide apart from the stationary rail, wherein the stationary rail at the outer end thereof and near two lateral sides thereof has a protruding catch hook with an opening facing inwardly from an intermediate side thereof, and the ball device at an outer end thereof has a central lower open groove accommodating the hollow stopper with two lateral sides of the open groove having hook ends respectively engaging with the catch hook such that the ball device is stopped at a predetermined location when the movable rail is pulled outwardly.

2. The guide rail assembly for a drawer as defined in claim 1, wherein the hollow stopper at an inner side thereof has an inclined stopper end and at an outer side thereof extends downward a declining plane such that the projection presses against the stopper as the outward movement limit of the movable rail.

* * * * *